United States Patent [19]

Watanabe

[11] Patent Number: 4,689,455

[45] Date of Patent: Aug. 25, 1987

[54] SNAP FITTED PUSH-BUTTON SWITCH ACTUATOR ASSEMBLY

[75] Inventor: Toshio Watanabe, Saijo, Japan

[73] Assignee: Matsushita Electric Industry Co., Ltd., Osaka, Japan

[21] Appl. No.: 821,549

[22] Filed: Jan. 22, 1986

[30] Foreign Application Priority Data

Jan. 25, 1985 [JP] Japan ..... 60-12988
Jan. 25, 1985 [JP] Japan ..... 60-12989
Jan. 25, 1985 [JP] Japan ..... 60-12990

[51] Int. Cl.[4] ..... H01H 13/00; H01H 3/12

[52] U.S. Cl. ..... 200/340; 200/159 R; 200/331; 200/5 A; 200/153 T

[58] Field of Search ..... 200/340, 339, 330–332, 200/329, 159 R, 153 T, 3 R, 5 A, 295, 296, 293, 159 B

[56] References Cited

U.S. PATENT DOCUMENTS 3,916,150 10/1975 Abernethy et al. ..... 200/340
4,029,916 6/1977 Chu ..... 200/5 A
4,136,270 1/1979 Wernet et al. ..... 200/340
4,190,748 2/1980 Langford ..... 200/5 A
4,280,026 7/1981 Alessio ..... 200/331 X
4,387,282 6/1983 Latasiewicz ..... 200/340
4,559,427 12/1985 Dolsom et al. ..... 200/5 A
4,613,736 9/1986 Shichijo et al. ..... 200/340 X

FOREIGN PATENT DOCUMENTS 2459464 6/1975 Fed. Rep. of Germany ..... 200/340
3205575 8/1983 Fed. Rep. of Germany ..... 200/330
1496640 12/1977 United Kingdom ..... 200/5 A

*Primary Examiner*—Stephen Marcus
*Assistant Examiner*—Ernest G. Cusick
*Attorney, Agent, or Firm*—Wenderoth, Lind & Ponack

[57] ABSTRACT

A switch actuating assembly for controlling an electric switch comprising a push-button assembly including at least one push-button, a fitting plate generally perpendicular to the push-button, an actuating rod extending from the push-button and having a free end adapted to control the switch, and a resiliently yieldable member connecting the push-button and the fitting plate together and providing a hinge axis about which the push-button can pivot from a release position to a depressed position against its own resiliency. The switch actuating assembly also comprises a panel having a mounting recess defined therein for the support of the push-button assembly.

12 Claims, 12 Drawing Figures

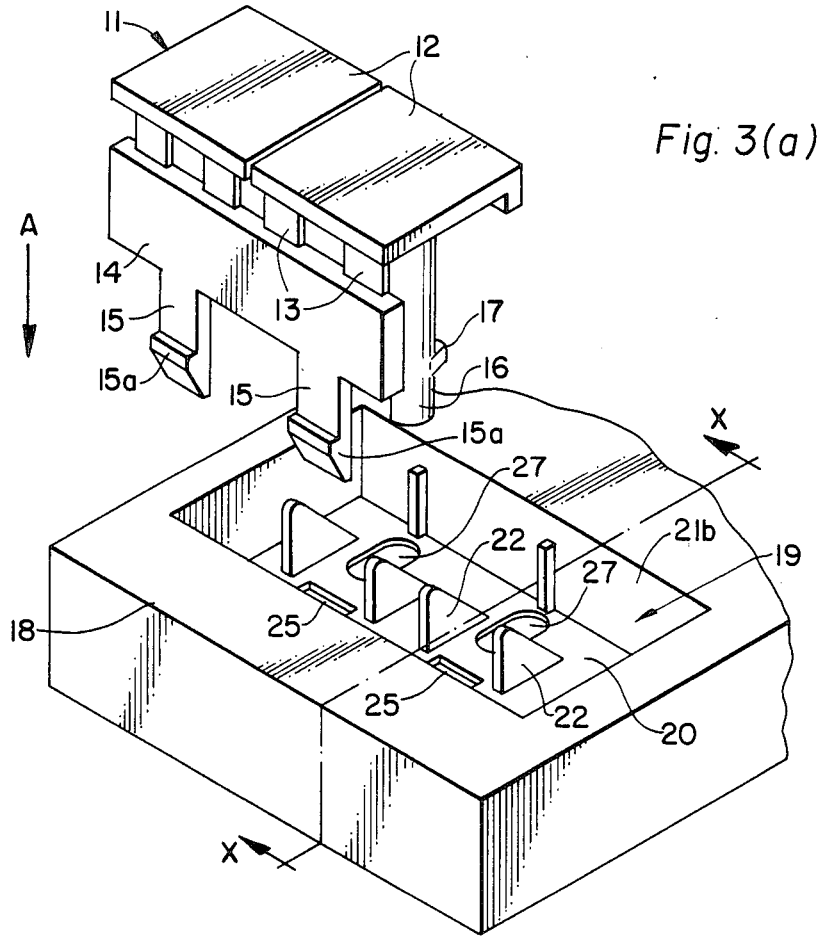
Fig. 3(a)
Fig. 3(b)
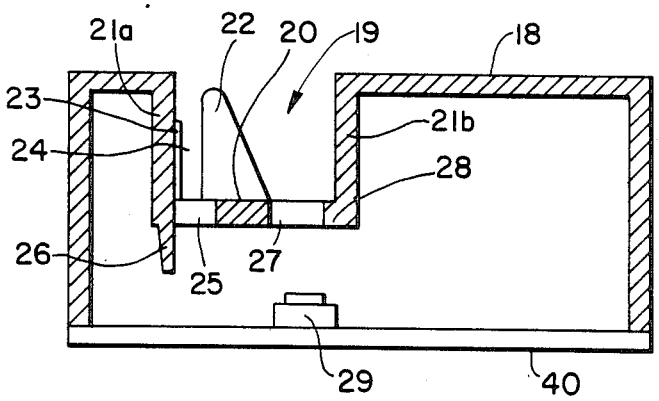

SNAP FITTED PUSH-BUTTON SWITCH ACTUATOR ASSEMBLY

BACKGROUND OF THE INVENTION

1. Field of the Invention:

The present invention generally relates to a switch actuating assembly and, more particularly, to a push-button assembly having at least one push-button operatively associated with an electric switch.

2. Description of the Prior Art:

Some electric appliances having, for example, a plurality of function controlling switches employ a switch panel at which push-buttons of identical design for aesthetic purpose are clustered while operatively associated with the respective switches. Even though in most cases the switches as manufactured have their own actuators, i.e., push-buttons, the push-buttons clustered at the switch panel while operatively linked with the built-in actuators of the respective switches serve as substantial actuators for those switches while providing the respective electric appliance with an appearance comfortable to look at and/or convenient to handle.

An example of the prior art switch actuating assembly wherein the push-buttons, one for each switch, are arranged in a side-by-side fashion is illustrated in FIGS. 1 and 2, reference to which will now be made for the detailed discussion of the prior art believed to be closest to the present invention.

The prior art switch actuating assembly shown therein comprises a cluster of two generally rectangular push-buttons each generally identified by 1. In practice, the push-button cluster is of one-piece construction as manufactured by a plastics molding technique and this is illustrated by the fact that the two push-buttons 1 are integrally connected at one end together through a bridge 1*a*. In any event, the push-buttons 1 are of the same design each having a generally square operating area 2, defined at one end portion thereof remote from the bridge 1*a*, and a fitting area 5 defined at the opposite end portion thereof adjacent the bridge 1*a*. The fitting area 5 of each of the push-buttons 1 has a transversely extending thinwalled region 3 so defined and so positioned as to provide a hinge axis about which the operating area 2 of the respective push-button 1 can pivot between released and depressed positions, it being, however, that the thin-walled region 3 has a resiliency necessary to permit the operating area to assume the released position at all times unless an external pushing force is applied to the operating area 2 in a direction shown by the arrow A.

Each of the push-buttons 1 has an actuating rod 4 having one end integral therewith and extending from the operating area 2 in a direction perpendicular to the longitudinal dimension thereof and conforming to the direction in which the external pushing force is applied to the operating area 2. Eachof the push-buttons 1 also has at least one fitting hole 6 defined in the fitting area 5 at a location on one side of the hinge axis, i.e., the thin-walled area 3, opposite to the operating area 2 for the securement of the push-button cluster to a cabinet 7 in a manner which will now be described.

The cabinet 7 is of a generally box-like configuration having one wall formed with a rectangular opening 9 of a size sufficient to allow the operating areas 2 of the respective push-buttons 1 to be received therein and exposed to the outside therethrough so as to be accessable to a finger of an operator. The wall of the cabinet 7 having the opening 9 defined therein has its interior surface formed with thermally fusible mounting bosses 8 which will project through the mounting holes 6 in the push-button cluster when the latter is fitted thereto with the operating areas 2 situated within the opening 9. As best shown in FIG. 2, after the push-button cluster has been fitted to the cabinet wall with the bosses 8 protruding through the holes 6, the free ends of the bosses 8 situated on one side of the holes 6 remote from the cabinet wall are heat-treated so as to substantially rivet the push-button cluster to the cabinet wall.

Positioned below, as viewed in FIG. 2, the free ends of the actuating rods 4 are electric switches 10 each to be actuated by a respective push-button 1.

The prior art switch actuating assembly of the above described design operates in this manner. Namely, when the operator applies an external pushing force to one of the operating areas 2 which are exposed to the outside through the opening 9 in the cabinet 7, the operating area 2 so applied with the external pushing force pivots from the release position towards the depressed position about the hinge axis against the resiliency of the thin-walled region 3, accompanied by the downward shift of the associated actuating rod 4 as viewed in FIG. 2, thereby actuating one of the switches 10 which is aligned with the operating area 2 that is depressed. Release of the external pushing force from the operating area 2 results in the automatic return of the operating area 2 from the depressed position to the release position by the action of the resiliency of the thin-walled region 3.

The prior art switch actuating assembly has some problems. In the first place, considering that the mounting bosses 8 are not permitted to be formed on the outer surface of the cabinet wall for aesthetic reasons, a complicated and time-consuming procedure is required to mount the push-button cluster from the interior of the cabinet.

In addition, in view of the fact that the pushbutton cluster employed in the prior art switch actuating assembly is of a general design spreading laterally of the cabinet wall to which it is fitted, and occupies a relatively large space of the cabinet wall for installation thereof, it is not easy to secure the fitting areas 5 of the push-button cluster to the interior surface of the cabinet wall particularly where some component parts aggregate around and adjacent the fitting areas inside the cabinet.

SUMMARY OF THE INVENTION

The present invention has been developed to substantially eliminate the above described disadvantages and inconveniences inherent in the prior art switch actuating assembly and has for its essential object to provide an improved switch actuating assembly which does not require the interior mounting of any part, i.e., mounting of any part of the assembly from behind a wall member to which it is fitted and which is, therefore, simple to manufacture with no relatively large space required.

In order to accomplish this object of the present invention, there is provided an improved switch actuating assembly for controlling an electric switch, which comprises a push-button assembly including at least a push-button member, a fitting member lying in a plane generally perpendicular to the push-button member, an actuating rod having one end rigidly connected with the push-button member and the other end adapted to control the electric switch, and extending at right angles to the push-button member in side-by-side fashion to the fitting member, and a resiliently yieldable member connecting the push-button member and the fitting member together so as to permit the assembly of the push-button and fitting members to represent a generally inverted L-shaped configuration, said resiliently yieldable member providing a hinge axis about which the push-button member can pivot from a release position towards a depressed position relative to the fitting member and having a resiliency sufficient to urge the push-button member to the release position at all times during the absence of an external pushing force applied to the push-button member.

In combination with the push-button assembly of the construction outlined above, the switch actuating assembly also comprises a mounting panel having a mounting recess defined therein for receiving the push-button assembly. Preferably, the mounting recess is delimited by a bottom wall and at least one pair of opposite walls perpendicular to the bottom wall, the bottom wall having a through-hole defined therein for the passage of the actuating rod therethrough. The switch actuating assembly further comprises a retaining means provided in the mounting panel for retaining the push-button assembly in position generally within the mounting recess, with the actuating rod loosely extending through the through-hole in the bottom wall and terminating in the vicinity of the electric switch to be controlled.

The provision of the mounting recess in the mounting panel which may be a portion of the cabinet or an instrument panel or a portion of any switch box makes it possible for the push-button assembly to be fitted exteriorly of the mounting panel through the opening of the mounting recess, with no need to remove the mounting panel of the cabinet such as required with the prior art switch actuating assembly. Moreover, since the fitting member extends behind the push-button member in a direction conforming to the direction in which the actuating rod extends, the space of the mounting panel occupied by the push-button assembly can be minimized.

BRIEF DESCRIPTION OF THE DRAWINGS

This and other objects and features of the present invention will become clear from the following description taken in conjunction with preferred embodiments thereof with reference to the accompanying drawings, in which:

FIG. 3(*a*) is an exploded view of a switch actuating assembly according to one form of embodiment of the present invention;

FIG. 3(*b*) is a sectional side view of the switch actuating assembly taken along line X—X of FIG. 3(*a*) with the push button assembly removed;

DETAILED DESCRIPTION OF THE EMBODIMENTS

Figure 1:
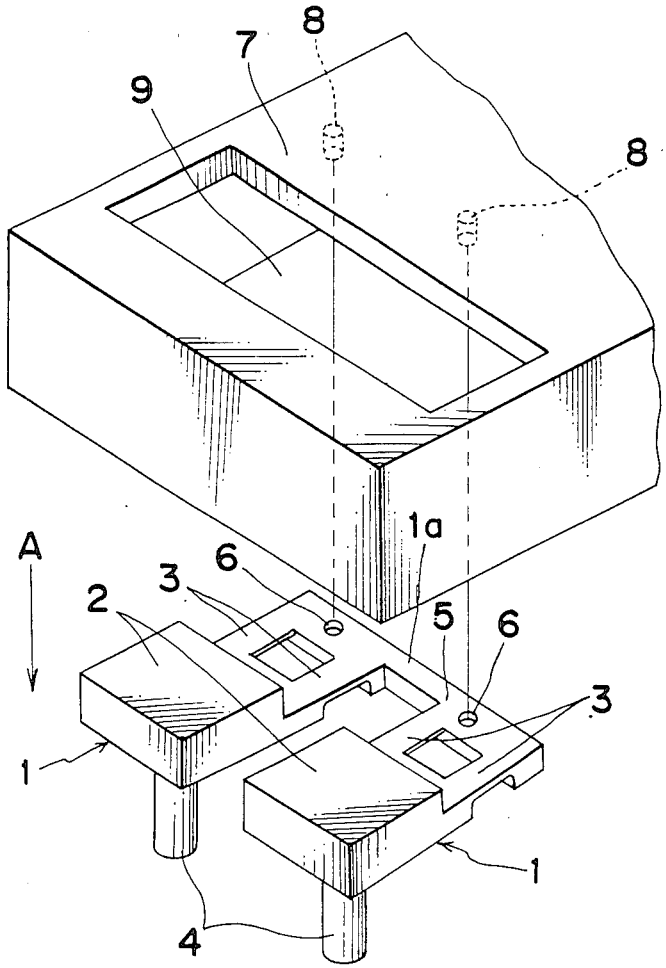
Fig. 1 Prior Art
FIG. 1 is an exploded view of the prior art switch actuating assembly.
Figure 2:
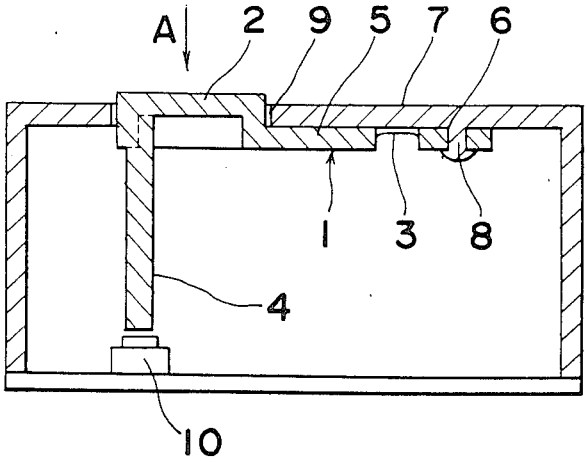
Fig. 2 Prior Art
FIG. 2 is a sectional side view of the prior art switch actuating assembly shown in FIG. 1.

Before the description of the present invention proceeds, it is to be noted that like parts are designated by like reference numerals throughout the accompanying drawings, except for FIGS. 1 and 2.

Referring first to FIGS. 3(*a*), (*b*) to 5, there is shown a push-button assembly of one-piece construction generally identified by 11. The push-button assembly shown includes a pair of juxtaposed, generally square plate-like push-buttons 12 each having an actuating rod 16 integrally formed therewith and extending from the bottom surface thereof at right angles thereto, a common rectangular fitting plate 14 lying in a plane perpendicular to the plane in which the push-buttons 12 lie and connected at one side edge to respective one of side edges of the push-buttons 12 by means of resiliently yieldable members generally identified by 13 two of which are provided for each push-button 12. These resiliently yieldable members 13 for each push-button 12 are formed by a thin-walled area perforated so to have the resiliently yieldable members on respective sides of the perforation in the thin-walled area. It is, however, to be noted that the perforation in the thin-walled area for each push-button 12 may not be always necessary and the thin-walled area itself may constitute a single resiliently yieldable member for each push-button 12.

The fitting plate 14 has the side edge, opposite the side edge from which the yieldable members 13 extend, formed with a pair of spaced legs 15 each having one end integral with the fitting plate 14 and the other end formed into a respective anchoring hook 15*a*, which hook 15*a* is positioned on one side of the fitting plate 14 remote from the associated push-button 12. The function of each of the anchoring hooks 15*a* will be described later.

A stopper projection 17 is formed on a portion of each of the actuating rods 16 adjacent the free end thereof, the function of which projection 17 will be described later.

Figure 5:
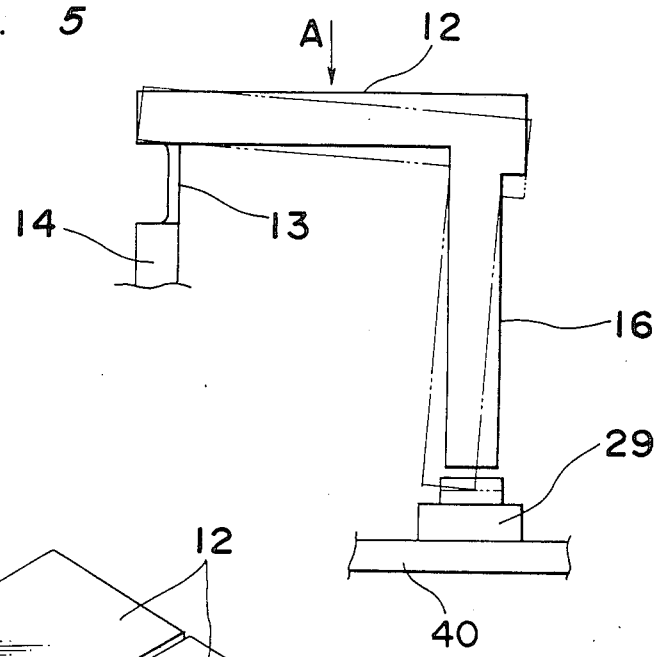
FIG. 5 is a side view, on an enlarged scale, of a push-button assembly used in the switch actuating assembly of FIGS. 3 and 4, showing the movement thereof in relation to an electric switch to be controlled.

In the construction so far described, when an external pushing force is applied to the upper surface of any one of the push-buttons 12 in a direction shown by the arrow A and conforming to the direction in which the actuating rods 16 project from the respective push-buttons 12, the resiliently yieldable members 13 associated with the push-button 12 then receiving the external pushing force yield against their own resiliency to permit such push-button 12 to pivot from a release position, shown by the solid line in FIG. 5, towards a depressed position, shown by the phantom line in FIG. 5, relative to the fitting plate 14 about the hinge axis provided by the paired resiliently yieldable members 13.

Electric switches 29 are provided one for each push-button 12 and are adapted to be controlled by the actuating rods 16 integral with the push-buttons 12, respectively. These switches 29 are rigidly mounted on, for example, a base board 40.

Figure 4:
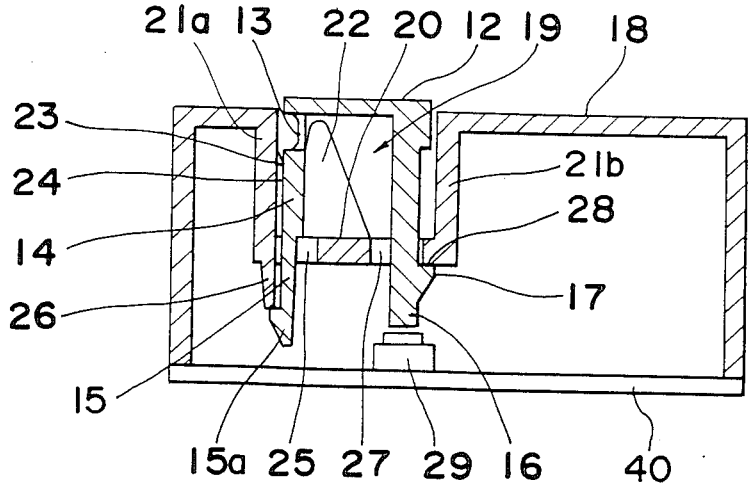
FIG. 4 is a sectional side view of the switch actuating assembly taken along line X—X of FIG. 3(*a*) with the push button assembly inserted.

The push-button assembly 11 of the construction detailed hereinbefore is operatively fitted to a mounting panel 18, which may, as viewed in FIG. 4, be a top wall of a generally closed box with the bottom delimited by the base board 40. For this purpose the mounting panel 18 has a mounting recess 19 defined therein and delimited by a bottom wall 20, a pair of opposite end walls which may not be always necessary and may be omitted if desired, and a pair of opposite side walls 21*a* and 21*b*, said mounting recess 19 being of a configuration similar to the shape represented by a combination of the push-buttons 12, that is, of a rectangular configuration as shown.

For each leg 15 of the push-button assembly 11, the bottom wall 20 is formed with a slot 25 defined therein adjacent the side wall 21*a* for the passage of the respective leg 15 therethrough. For each actuating rod 16, the bottom wall 20 is also formed with a through-hole 27 defined therein adjacent the side wall 21*b* for the loose passage of the respective actuating rod 16 therethrough.

Rigidly mounted on, or otherwise integrally formed with the bottom wall 20, and projecting towards the opening of the mounting recess 19 is a plurality of generally triangular strut members 22 each having an upright side face extending parallel to the side wall 21*a*. The number of the triangular strut members 22 for each push-button 12 may be one or more, but in the illustrated embodiment, two triangular members 22 are shown for each push-button 12 and are arranged on respective sides of the associated through-hole 27. Each of the upright side faces of the respective triangular strut members 22 fastened or integral with the bottom wall 20 defines, in cooperation with regulating ribs 23 of said side wall 21a that are formed integrally therewith, a retaining space 24 for receiving and retaining the fitting plate 14 extending in a direction parallel relation to a depth-wise direction of the recess 19.

The mounting of the push-button assembly 11 onto the mounting panel 18 is carried out by aligning the legs 15 and the actuating rods 16 with the slots 25 and the through-holes 27, respectively, and then pushing the assembly 11 into the mounting recess 19 to allow the anchoring hooks 15*a* and the stopper projections 17 to pass through the slots 25 and the through-holes 27 respectively while the fitting plate 14 and the actuating rods 16 are displaced in a direction towards each other during the continued passage of the anchoring hooks 15*a* and the stopper projections 17 through the slots 25 and the through-holes 27. In an assembly condition shown in FIG. 4, the anchoring hooks 15*a* are engaged with an engagement means projection 26 integrally formed with the bottom wall 20 so as to extend downwards, i.e., in a direction conforming to the direction in which the legs 15 extend, while the stopper projections 17 are engaged with respective peripheral edges 28 of the through-holes 27 from below. Therefore, once the push-button assembly 11 has been so mounted, it will not separate from the mounting panel 18 out of the mounting recess 19 unless an external force is applied to the push-button assembly to bring the fitting plate 14 and the actuating rods 16 towards each other to let the anchoring hooks 15*a* and the stopper projections 17 disengage respectively from the engagement means projection 26 and the peripheral edges 28 of the through-holes 27.

The width of the retaining space 24 measured in terms of a distance between the upright side face of each triangular strut member 22 and the free side face of each regulating rib 23 opposite to the side wall 21*a*, is selected to have dimensions that permit the fitting plate 14 to be substantially press-fitted in the retaining space 24 thereby to firmly retain the entire push-button assembly 11 in position within the mounting recess 19.

The switch actuating assembly of the construction described hereinbefore operates in the following manner.

When an external pushing force is applied to the upper surface of one of the push-buttons 12 both normally held in the release positions, as shown in FIG. 4 and as shown by the solid line in FIG. 5, in the direction A, the push-button 12 receiving the external pushing force pivots towards the depressed position, shown by the phantom line in FIG. 5, against the resiliency of the associated resiliently yieldable members 13 while the latter deflect. By this deflection, the resiliently yieldable members 13 associated with the depressed push-button 12 provide the hinge axis about which the depressed push-button 12 pivots between the release and depressed positions.

With the push-button 12 so depressed, the associated actuating rod 16 integral with the bottom surface of the push-button 12 shifts downwards as viewed in FIG. 4, i.e., in a direction towards the associated electric switch 29. Thus, it is clear that, when the push-button 12 receiving the external pushing force arrives at the depressed position, the associated electric switch 29 is actuated by the associated actuating rod 16 so as to assume one of a plurality of switching positions.

Release of the external pushing force from the depressed push-button 12 results in the automatic return of the push-button 12 to the release position by the action of the resiliency of, and about the hinge axis defined by, the resiliently yieldable members 13.

Although each of the triangular strut members 22 may have any height, as measured from the bottom wall 20 towards the associated push-button 12, sufficient to support the plate member 14 against the retaining ribs 23, it is preferred that at least one of the apex portions of member 22 associated with a respective push-button 12 terminate at such a distance from the bottom surface the push-button 12 so as to accommodate the pivotal movement of the associated push-button, but while that one apex contacts the bottom surface of the associated push-button substantially simultaneously with the arrival of the push-button 12 at the depressed position. With this arrangement, it is possible to avoid any possible complex deformation of the resiliently yieldable members which would result in a loss of resiliency thereof or early breakage thereof.

The stopper projection 17 shown and described as formed on each of the actuating rods 16 for engagement with the peripheral edge 28 of the respective through-hole 27 when and so long as the associated push-button 12 is in the release position may not be always necessary. However, the provision of the stopper projection 17 in each actuating rod 16 is effective to prevent the associated resiliently yieldable members 13 from being pulled so excessively as to result in the breakage thereof when an excessive external pulling force acting in a direction counter to the direction A is applied to the upper surface of the associated push-button 12. In any event, in the illustrated embodiment, the stopper projection 17 on each actuating rod 16 may be so positioned as to have a space between it and the peripheral edge 28 of the associated through-hole 27 even when the associated push-button 12 is held in the release position, unless such space is of a size which would result in the excessive pull of the resiliently yieldable members 13.

The switch actuating assembly according to the present invention may have means for restricting the stroke of pivotal movement of each push-button 12 between the release and depressed position for the purpose of avoiding the application of an excessive pushing force to the associated electric switch 29 through the associated actuating rod 16. The provision of the restricting means is also effective to avoid any possible breakage of the resiliently yieldable members 13 which would occur when the push-button 12 having arrived at the depressed position, is further depressed, while the associated electric switch 29 has not yet been installed, to such an extent so as to permit the push-button to rotate about the apex portion of each triangular strut member 22 then brought into contact with the undersurface of such push-button 12.

Figure 6:
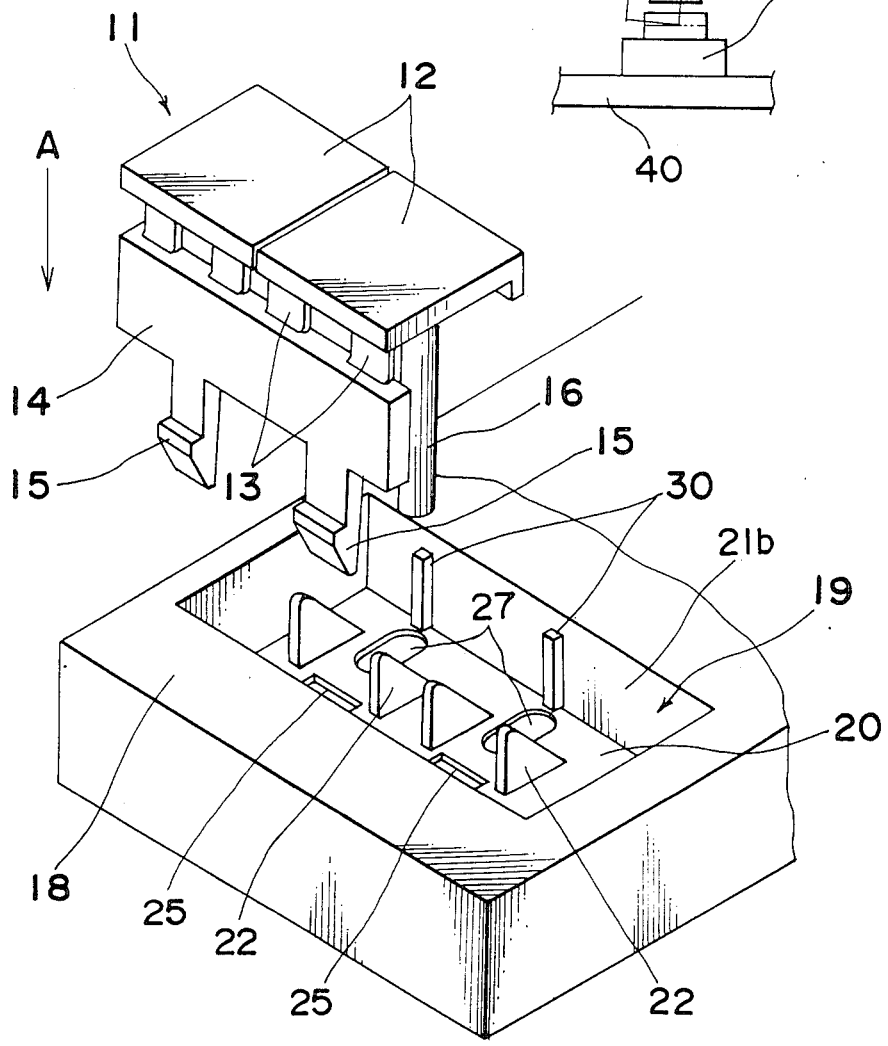
FIGS. 6, 7 and 8 are views similar to FIGS. 3, 4 and 5, respectively, showing another embodiment of the present invention.
Figure 7:
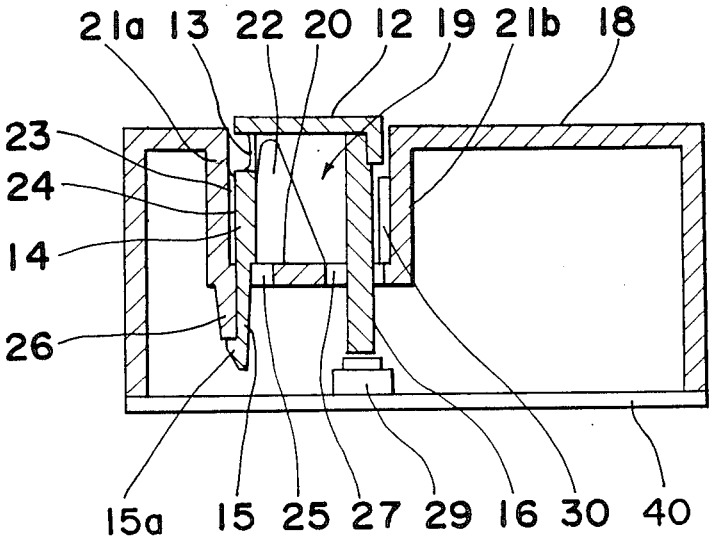
Figure 8:
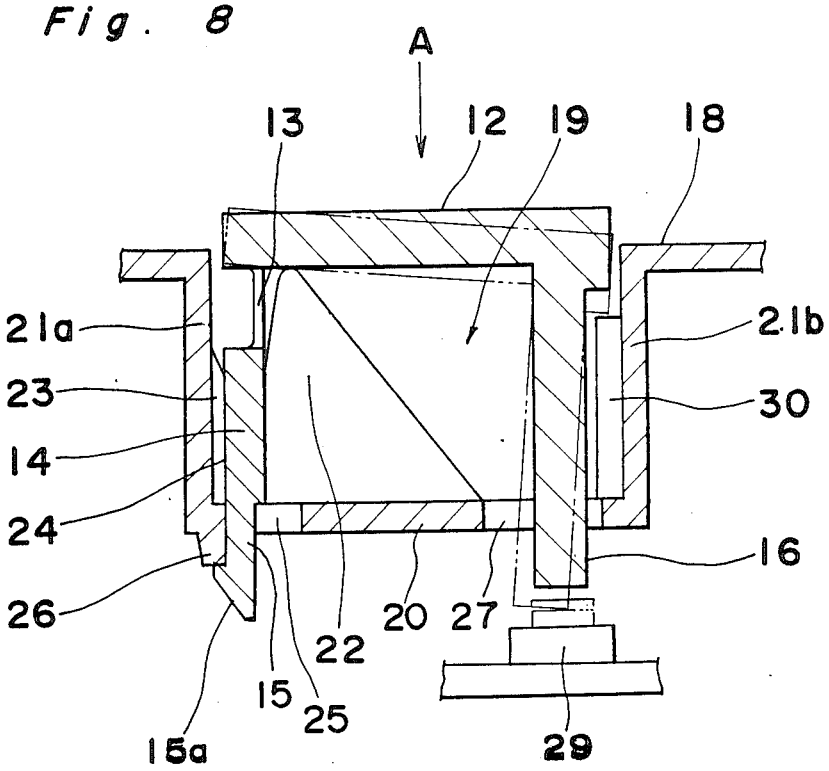

In the embodiment shown in FIGS. 6 to 8, the restricting means referred to hereinabove comprises at least one restricting rib 30 for each push-button 12, which rib 30 is rigidly secured to, or otherwise integrally formed with one of the opposite end and side walls, for example, the side wall 21*b* as shown. The length of the restricting rib 30 is selected so as to permit the side edge of the associated push-button 12 other than that adjacent the resiliently yieldable members 13 to contact the restricting rib 30 when the associated push-button 12 has been pivoted to the depressed position as best shown by the phantom line in FIG. 8.

Where each of the restricting ribs 30 is formed on one of the opposite end walls of the mounting recess 19, it is preferred to locate the respective restricting rib 30 at a position distant from the hinge axis about which the associated push-button 12 pivots, and adjacent the side wall 21*b*.

It is to be noted that although each restricting rib 30 has been described as rigidly secured or integrally formed with one of the walls surrounding the mounting recess 19 other than the side wall 21*a*, the restricting means may be constituted by a step or shoulder protruding inwardly from such one of the walls inwardly of the mounting recess 19.

Figure 9:
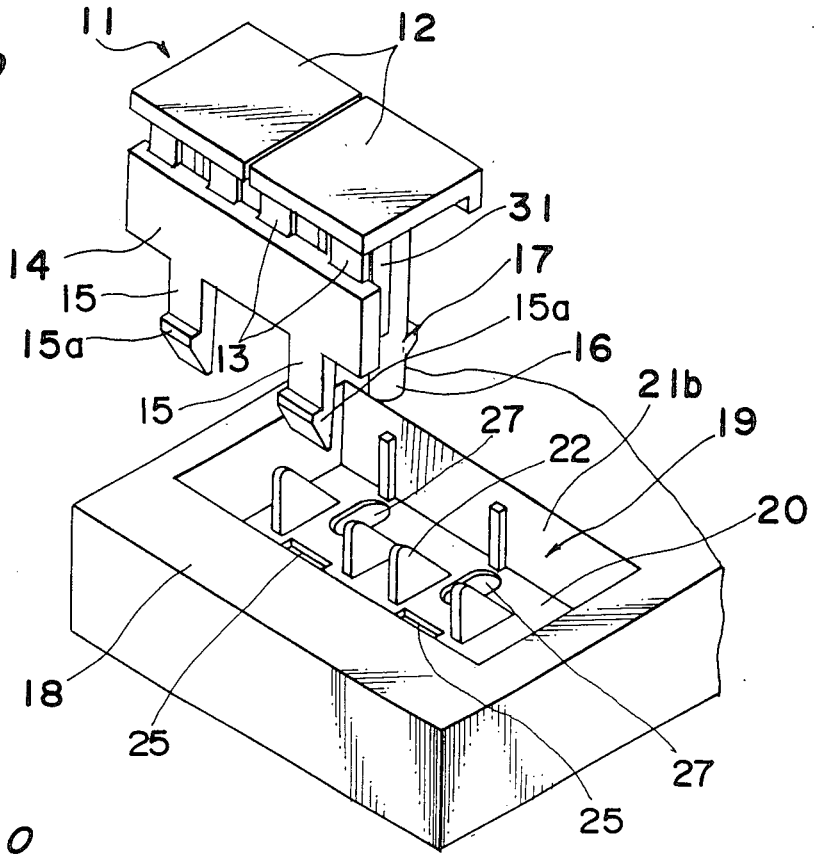
FIGS. 9, 10 and 11 are views similar to FIGS. 3, 4 and 5, respectively, showing a further embodiment of the present invention.
Figure 10:
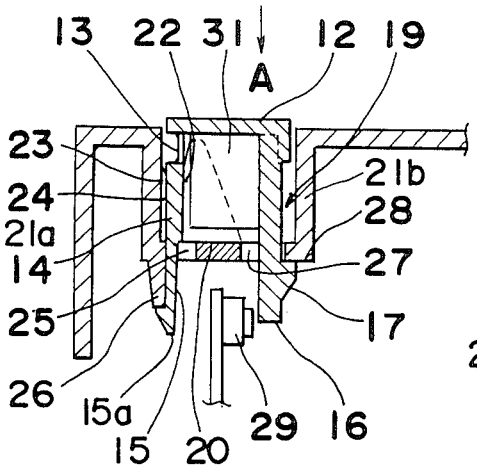
Figure 11:
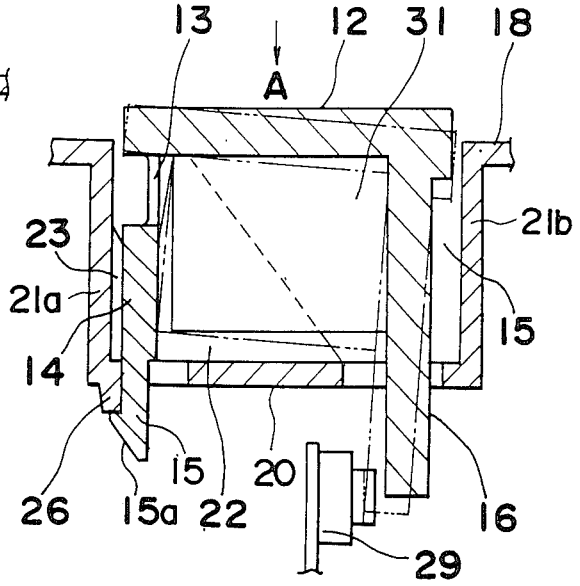

In the embodiment shown in FIGS. 9 to 11, the restricting means comprises at least one restricting plate 31 of a shape having four, generally right-angled corners, employed for each push-button 12. The restricting plate 31 has two adjacent sides rigidly secured to, or integrally formed with, the associated push-button 12 and the associated actuating rod 16, and in the assembled condition, is positioned between and extends in a plane parallel to paired triangular strut members 22. Each plate 31 is sized such that one of the opposite sides remote from the associated actuating rod 16 can, when and so long as the associated push-button 12 is held in the release position as best shown by the solid line in FIG. 11, be spaced by a predetermined distance from the fitting plate 14, which distance is determinative of the stroke of pivotal movement of the associated push-button 12. One of the opposite sides of the respective plate 31 remote from the associated push-button 12 may, or may not, contact the bottom wall 20 when such associated push-button 20 has been pivoted to the depressed position. The embodiment shown in FIGS. 9 to 11 is effective to maximize the utilization of a dead space delimited by the push-buttons 12, the actuating rods 16, the fitting plate 1 and the bottom wall 20.

In all of the foregoing embodiments of the present invention, as a matter of design, the actuating rod 16 of any one of the push-buttons 12 does not shift in a linear direction when one of the push-buttons 12 is depressed. As can be understood from the comparison of the solid and phantom lines employed in each of FIGS. 5, 8 and 11, the actuating rod 16, when the associated push-button 12 is depressed, shifts downwards and, at the same time, swings laterally to follow a curved path having its center of curvature coinciding with the hinge axis about which the associated push-button 12 when depressed pivots. In view of this, the electric switch 29 to be controlled by the associated actuating rod 16, which in the embodiments shown in FIGS. 3 to 5 and FIGS. 6 to 8 has been installed so as to receive a downwardly acting push from the associated actuating rod 16, may be installed so as to receive from the associated actuating rod a push acting in a direction generally transversely of the longitudinal dimension of the associated actuating rod 16 as shown in FIGS. 9 to 11.

Although the present invention has been fully described by way of example with reference to the accompanying drawings, it is to be noted here that various changes and modificatios will be apparent to those skilled in the art, without departing from the scope of the present invention as defined by the appended claims.

By way of example, where the push-button assembly 11 in any one of the foregoing embodiments is made of synthetic resin, the resiliently yieldable members 13 can be constituted by a thin-walled area, for each push-button 12, that connects the plate 14 and the associated push-button 12 together. However, the resiliently yieldable members 13 for each push-button 12 may be made of resilient metal, for example, aluminum. Alternatively, the push-button assembly 11 itself may be made of light metal, for example, aluminum.

Moreover, although each leg 15 has been described as integrally formed with the respective anchoring hook 15*a* cooperable with the engagement projection 26, the anchoring hook may be formed with the bottom wall 20 while the engagement projection means 26 may be constituted by an extension of the respective leg.

The stopper projection 17 operable to keep the respective push-button 12 at the release position may not be always formed on the associated actuating rod 16, but may be formed on any one of the sidewalls, for example 21*b*, defining the mounting recess 19.

When the push-button assembly 11 itself is manufactured, it is preferred that an angle between each push-button 12 and the fitting plate 14 is greater than 90° so that, when the push-button assembly so manufactured is mounted into the mounting recess 19 in the mounting panel 18, the resiliently yieldable members 13 can accumulate respective biasing forces acting to urge the push-buttons 12 in a pivotal direction counter to the direction A. This is particularly applicable to the first and third mentioned embodiments of the present invention, or to any embodiment of the present invention wherein means for retaining each of the push-buttons 12 at the release position, so long as no external pushing force is applied thereto, is employed.

Accordingly, such changes and modifications are to be understood as included within the scope of the present invention.

What is claimed is:

1. A push-button switch actuator assembly comprising:

a mounting panel having a mounting recess in a surface thereof having opposite sidewalls defining the sides of of said recess, and an engagement means on one of said sidewalls;

a switch mounted to said mounting panel adjacent said recess; and a push-button assembly mounted to said mounting panel in said recess for actuating said switch, said push-button assembly comprising at least one push-button having an upper surface exposed at said surface of said mounting panel and a bottom surface opposite said upper surface, a fitting plate extending from the bottom surface of said push-button toward a free end thereof, said fitting plate abutting against one of said sidewalls that defines the sides of said recess for positioning said push-button assembly within said recess, an anchoring hook member at said free end of said fitting plate engaging said engagement means for retaining said push-button assembly in said recess, and said fitting plate having a resilient thin-walled portion at a location between said anchor hook member and said bottom surface of said push-button, and an actuating rod extending from the bottom surface of said push-button toward said switch and in a direction that is substantially parallel to the direction in which said fitting plate extends, said actuating rod and said fitting plate extending between said sidewalls defining the sides of said recess and spaced from one another by a distance between said sidewalls defining the sides of said recess such that said push-button assembly is insertable into said recess from a position outside said mounting panel facing said surface thereof, said actuating rod actuating said switch when an external force is exerted on said upper surface of said push-button which causes said push-button to pivot in a pivotal direction about said thin-walled portion of said fitting plate to move said actuating rod toward and into contact with said switch to actuate said switch.

2. A push-button switch actuator assembly as claimed in claim 1, and further comprising a strut member extending within said recess toward said bottom surface of said push-button at a position adjacent said thin-walled portion for restricting said push-button from pivoting in said pivotal direction about said thin-walled portion when said actuating rod has actuated said switch by abutting said bottom surface of said push-button when said actuating rod actuates said switch.

3. A push-button switch assembly as claimed in claim 2, wherein said strut member extends from the bottom of said recess toward said bottom surface of said push-button.

4. A push-button switch actuator assembly as claimed in claim 1, and further comprising a restricting rib extending within said recess toward said bottom surface of said push-button for restricting said push-button from pivoting in said pivotal direction about said thin-walled portion when said actuting rod has actuated said switch by abutting said bottom surface of said push-button when said actuating rod actuates said switch.

5. A push-button switch assembly as claimed in claim 1, and further comprising a stopper projection extending from said actuating rod, said stopper projection engaging said mounting panel when no external force is exerted on said surface of said push-button to position said actuating rod at a release position whereat said actuating rod is out of actuating engagement with said switch.

6. A push-button switch assembly as claimed in claim 1, and further comprising a restricting plate extending from said bottom surface of said push-button and spaced from said fitting plate for restricting said push-button from pivoting in said pivotal direction about said thin-walled portion by abutting said fixing plate when said actuating rod actuates said switch.

7. A push button switch actuator assembly comprising:

a mounting panel having a mounting recess in a surface thereof, and an engagement means on said mounting panel;

a switch mounted to said mounting panel adjacent said recess; and a push-button assembly mounted to said mounting panel within said recess for actuating said switch, said push-button assembly comprising at least one push-button having an upper surface exposed at said surface of said mounting panel, a bottom surface opposite said upper surface, and a side edge extending between said upper and bottom surfaces, a fitting plate extending from the bottom surface of said push-button toward a free end thereof, said fitting plate abutting against a sidewall of said mounting panel that defines a side of said recess for positioning said push-button assembly within said recess, an anchoring hook member at said free end of said fitting plate engaging said engagement means on said mounting panel for retaining said push-button assembly in said recess, and said fitting plate having a resilient thin-walled portion at a location between said anchor hook member and said bottom surface of said push-button, and an actuating rod extending from the bottom surface of said push-button toward said switch, said actuating rod and said fitting plate both extending within an area defined by and projected from said side edge of said push-button as viewed from said upper surface thereof such that said push-button assembly is insertable into said recess from a position outside of said panel member facing said surface thereof, said actuating rod actuating said switch when an external force is exerted on said upper surface of said push-button which causes said push-button to pivot in a pivotal direction about said thin-walled portion of said fitting plate to move said actuating rod toward and into contact with said switch to actuate said switch.

8. A push-button switch actuator assembly as claimed in claim 7, and further comprising a strut member extending within said recess toward said bottom surface of said push-button at a position adjacent said thin-walled portion for restricting said push-button from pivoting in said pivotal direction about said thin-walled portion when said actuating rod has actuated said switch by abutting said bottom surface of said push-button when said actuating rod actuates said switch.

9. A push-button switch assembly as claimed in claim 8, wherein said strut member extends from the bottom of said recess toward said bottom surface of said push-button.

10. A push-button switch actuator assembly as claimed in claim 7, and further comprising a restricting rib extending within said recess toward said bottom surface of said push button for restricting said push-button from pivoting in said pivotal direction about said thin-walled portion when said actuating rod has actuated said switch by abutting said bottom surface of said push-button when said actuating rod actuates said surface.

11. A push-button switch assembly as claimed in claim 7, and further comprising a stopper projection extending from said actuating rod, said stopper projection engaging said mounting panel when no external force is exerted on said surface of said push-button to position said actuating rod at a release position whereat said actuating rod is out of actuating engagement with said switch.

12. A push-button switch assembly as claimed in claim 7, and further comprising a restricting plate extending from said bottom surface of said push-button and spaced from said fitting plate for restricting said push-button from pivoting in said pivotal direction about said thin-walled portion by abutting said fixing plate when said actuating rod actuates said switch.

* * * * *